US006299415B1

(12) United States Patent
Bahrton

(10) Patent No.: US 6,299,415 B1
(45) **Date of Patent: *Oct. 9, 2001**

(54) DOUBLE-ACTING PUMP

(76) Inventor: Svante Bahrton, Stamstigen 13, Lidingö (SE), 181 47

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/945,420

(22) Filed: Oct. 27, 1997

(30) Foreign Application Priority Data

Apr. 27, 1995 (SE) ..... 9501564

(51) Int. Cl.[7] ..... F04B 43/06
(52) U.S. Cl. ..... 417/395; 417/533; 417/538
(58) Field of Search ..... 417/395, 533, 417/538; 92/48, 84

(56) References Cited

U.S. PATENT DOCUMENTS 1,835,919 * 12/1931 Waseige ..... 92/68
2,526,331 * 10/1950 Copping ..... 417/395
2,877,715 * 3/1959 Rittenhouse ..... 417/538
4,008,984 * 2/1977 Scholle ..... 417/395
4,496,294 * 1/1985 Frikker ..... 417/393
4,521,165 * 6/1985 Handleman ..... 417/393
5,219,274 * 6/1993 Pawlowski et al. ..... 417/213

FOREIGN PATENT DOCUMENTS 0132913 2/1985 (EP) .
763846 * 12/1956 (GB) ..... 417/538
1435-814-A 11/1988 (SU) .

* cited by examiner

*Primary Examiner*—Cheryl J Tyler
(74) *Attorney, Agent, or Firm*—Jacobson Holman, PLLC

(57) ABSTRACT

A double-acting pump having two cavities, each of which is divided into an operating chamber and a working chamber by means of a respective movable partition wall. Each of the operating and working chambers is provided with a valve-controlled inlet and outlet for a gaseous driving medium and a pump-transported liquid working medium. A movement transmission device extends between the movable partition walls and transmits movement of one partition wall to the other and vice versa. This movement transmission device includes a spring element for compression and expansion in the movement transmission direction such that a distance between the partition walls is variable as one partition wall can move independently of the other wall responsive to relative gas pressure in the operating chambers.

5 Claims, 1 Drawing Sheet

DOUBLE-ACTING PUMP

BACKGROUND OF THE INVENTION

FIELD OF THE INVENTION

The present invention relates to a double-acting pump of the kind which includes two cavities, each of which is divided into an operating chamber and a working chamber by means of a respective movable partition wall in the form of a piston or diaphragm, wherein each of the operating and working chambers is provided with a valve-controlled inlet and outlet for a gaseous driving and operating medium and for a pump-transported liquid working medium respectively, and wherein a device for transmitting movement of one partition wall to the other, and vice versa, extends between the movable partition walls.

DESCRIPTION OF THE RELATED ART

Double-acting pumps of this kind are known to the art from European Patent Specifications 0 132 913 and 0 181 756, for instance. The operating medium is normally air and the working medium one of the liquids that are pumped through pipes primarily in the food industry, the chemical process industry and the pharmaceutical industry. One drawback with known double-acting pumps is that they tend to generate undesirable pulsations in the transported working medium as a result of the particular conditions that prevail when the movement direction of the partition walls reverses.

SUMMARY OF THE INVENTION

An object of the present invention is to provide a novel and advantageous double-acting pump with which the aforesaid drawback is at least substantially eliminated. It is also an object of the present invention to provide a pump of the aforesaid kind which has a long working life, is reliable in operation, incurs low operating costs, has low specific driving-medium consumption and small space requirements.

To this end, there is proposed in accordance with the present invention a double-acting pump of the aforesaid kind in which the movement transmission device is resilient or springlike in the movement transmission direction. As a result of this arrangement, an operating chamber will be evacuated when reversing the pump stroke direction essentially independently of the filling of the other operating chamber, wherein the energy which in known double-acting pumps is initially consumed in emptying said one chamber while generating pulsations and delaying the filling of said other chamber is now stored in the resilient transmission device without impeding filling of said other chamber. The energy or power stored in the transmission device is utilized during the continuation of the pump stroke to empty said one chamber, when the pressure in this chamber has been reduced. In this way, the occurrence of pulsations caused by changes in direction of the movement of the partition walls is essentially avoided and the pump will consume less energy. Further energy savings and smoothness in the transportation of the liquid working medium can be achieved by using flap valves in the valve-controlled working medium inlets and outlets.

The movement transmission device includes a rod which is journalled for axial movement in the movement transmission direction and which has at least one end connected to an associated partition wall through a spring element. The spring element may be connected to the associated partition wall through connecting means which enable the end of the spring element to be positioned obliquely in relation to the partition wall and the rod end respectively.

As a further embodiment, the rod can include a two-part rod which is journalled for axial movement in the movement transmission direction and whose mutually opposing ends are each connected to a respective partition wall. The rod parts are then mutually connected through the medium of a spring element.

In accordance with the invention, the working chambers may be located closest to one another, with the operating chambers located outwardly of an associated partition wall. Additionally, each of the working chambers is connected to a common working medium inlet chamber located between the working chambers, through the medium of a flap valve mounted in a respective chamber wall, and each of the working chambers is further connected to a common working medium outlet chamber located between the working chambers, through the medium of a flap valve mounted in a respective chamber wall.-before

BRIEF DESCRIPTION OF THE DRAWINGS

Other characteristic features of the invention and advantages afforded thereby will be apparent from the following description of a number of exemplifying embodiments thereof illustrated in the accompanying drawings, in which.

Those components that find correspondence, or general correspondence, in the Figures have been identified with the same reference signs. Although the illustrated and described movable partition walls have the form of diaphragms, it will be understood that these diaphragms can be replaced with reciprocatingly movable pistons or plungers within the concept and scope of the invention.

DETAILED DESCRIPTION OF THE PREFERRED EMBODIMENT

Figure 1:
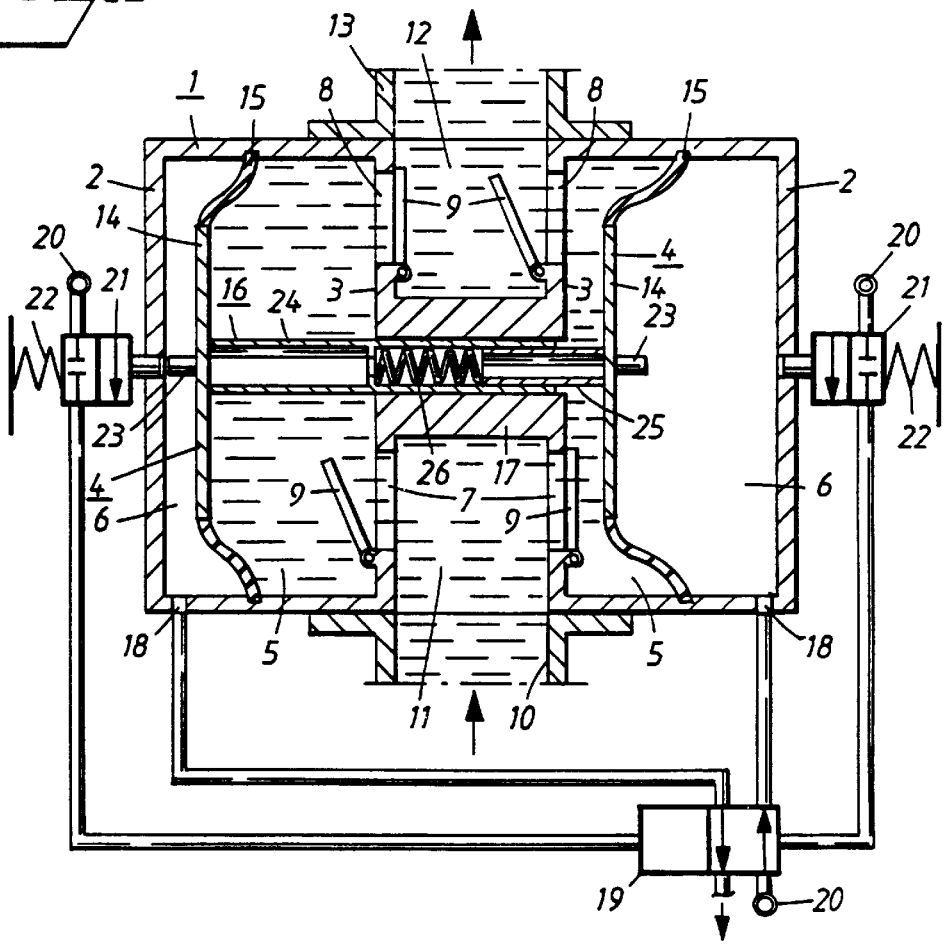
FIG. 1 is a sectional view of an inventive double-acting pump.

The double-acting pump illustrated in FIG. 1 is a so-called diaphragm pump having a generally cylindrical pump housing 1 which includes cavities or hollows defined by end walls 2 and inner walls 3. Each cavity in turn is divided into a working chamber 5 and an operating chamber 6 by means of respective partition walls or diaphragm units 4, wherein the working chambers 5 are located close together and the operating chambers 6 are located outwardly of associated diaphragm units 4. However, it lies within the concept of the invention to reverse the mutual positions of the chambers, i.e. with the operating chambers located close together and the working chambers being located on the outward side of associated diaphragm units. The working chambers 5 are provided with valve-controlled inlets and outlets for pump-transported liquid working medium. In the FIG. 1 embodiment, these inlets and outlets have the form of openings 7, 8 in the inner walls 3 of the working chambers, and check valves 9 which coact with said openings. These check valves may have the form of ball valves for instance, although they will preferably comprise flap valves in the manner illustrated. The use of flap valves and the novel positioning of the valve-controlled inlets and outlets directly in adjacent chamber walls 3 results in minimum deflection of the pumped working medium as it passes through the pump, and in minimum pressure losses, therewith making this valve arrangement highly favourable even in the case of arrangements that do not include the resilient movement transmission device of a preferred embodiment. The working medium arrives at the pump in the direction shown by an arrow, through a pipe or conduit 10 which opens into a space 11 located between the walls 3, and exits into a diametrically opposed space 12, also located between the walls 3, and leaves the pump through an outlet pipe 13, as indicated by an upper arrow.

Each of the diaphragm units 4 is comprised of a round, relatively rigid central part 14 and a peripheral part 15 which is made of a relatively soft, pliable material and which is connected to the pump housing 1 at its radially outer edge. The diaphragm units 4 are mutually connected by means of a device 16 which transmits the movements of one diaphragm unit 4 to the other, and vice versa. This device 16 is generally rod-shaped and is journalled for movement in the direction of its longitudinal axis in a bearing 17 mounted centrally in the pump housing 1. Thus, when the left diaphragm unit 4 in FIG. 1 moves to the right for instance, by pressurized operating medium or driving medium, for instance compressed air, entering the left operating chamber 6, and maneuvering or driving medium is released from the right operating chamber 6, the device 16 will press the right diaphragm unit 4 to the right. The movement transmission device of known pumps is incompressible in its axial direction. The movement transmitting device 16 of the illustrated embodiment, however, is resilient in its movement transmitting direction, as will be explained in more detail below.

The operating chambers 6 are provided at 18 with openings which function as driving medium inlets and outlets and which are connected to a pressurized driving-medium supply net 20 through the medium of a bi-stable two-position four-way valve 19. In turn, the valve 19 is moved to one or the other of its two positions by two mono-stable two-position two-way valves 21 which receive re-setting pulses from maneuvering pins 23 on the diaphragm units 4 against the action of the return springs 22, as said diaphragm units reach their respective outer limit or turning positions.

In the case of the FIG. 1 embodiment, the movement transmission device 16 journalled in the bearing 17 is comprised of two mutually telescopic parts 24, 25, each of which is connected to or is in abutment with its respective diaphragm unit 4 and which coact with a pressure spring 26 acting between said units and having the form of a coil spring in the illustrated case.

In the functional state illustrated in FIG. 1, the left diaphragm-unit 4 is located just short of its turning point at the end of its suction movement. The liquid working medium is sucked from the space 11 through the inlet 7 with the check valve 9 open, and into the left working chamber 5 whose check valve 9 in the outlet 8 is held closed by the pressure exerted by the liquid portion that is forced from the right working chamber 5 into the space 12 by the right diaphragm unit 4, said right diaphragm unit 4 being located near to the end of its pressure stroke. The right operating chamber 6 is connected to the driving medium supply net via the valve 19, and the left operating chamber 6 is evacuated via the same valve. In the next moment, the operating pin 23 on the left diaphragm unit actuates an associated control valve 21, such as to switch the valve to its unstable position while compressing the valve return spring 22, wherewith the valve allows driving medium to flow through and reset the valve 19 to its other, stable position. The pressure in the left operating chamber 6 will therewith rise almost immediately, said chamber having a small volume in this functional stage. The pressure in the right operating chamber 6 does not fall as quickly and the movement transmission device 16 would prevent movement of the left diaphragm unit 4 until the pressure in the right operating chamber had fallen if said device were not compressible. In the case of the illustrated arrangement, however, the left diaphragm unit 4 is movable independently of the right diaphragm unit during compression of the spring 26 and forced expulsion of working medium from the left working chamber 5. As driving medium exits from the right operating chamber 6 and the chamber is therewith relieved of pressure, the spring 26 will expand during continued movement of the diaphragm units 4 and the movement transmission device 16. The spring 26 therewith greatly reduces pulsation of the working medium flow on the pressure side of the pump and also the consumption of driving medium, since essentially no pressure energy is consumed in assisting in pressing the driving medium from the right operating chamber 6.

Figure 2:
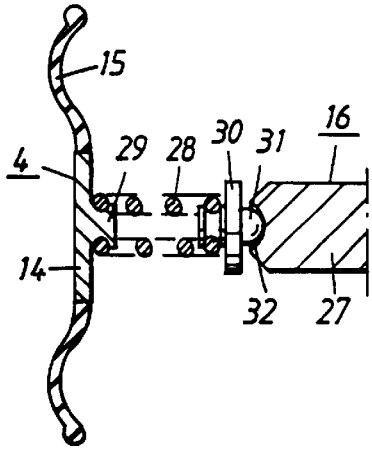
FIGS. 2 and 3 illustrate alternative embodiments of the movement transmission device according to the present invention.

FIG. 2 illustrates an alternative embodiment of the movement transmission device 16. In the case of this embodiment, the device is comprised of a rod 27, of which only a small part is shown. The rod 27 is connected at one or both ends to the diaphragm unit 4 through the medium of spring means which includes a spring element 28 in the form of a coil spring. One end of the spring element 28 is received in a circumferentially extending groove on a pin 29 formed on the central part 14 of the diaphragm unit 4, while the opposite end of the spring element 28 is connected to a connecting means 30 having a hemispherical part 31 which is received in a cup-shaped part 32 at the end of the rod. It will be apparent that this embodiment will enable the end of the spring element to be positioned slightly obliquely relative to the rod end.

Figure 3:
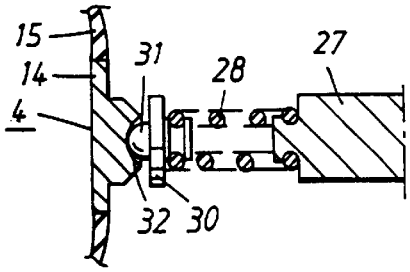

FIG. 3 illustrates the reverse arrangement, in which one end of the spring element 28 is connected to an opposing end of the rod 27, while the opposite end of the spring element is connected to a connecting means 30 in the form of a hemispherical part 31 which is received in a cupped part 32 of the diaphragm unit 4.

It will be understood that the invention is not restricted to the aforedescribed and illustrated exemplifying embodiments thereof and that the invention can be implemented in any desired manner within the scope of the inventive concept.

What is claimed is:

1. A double-acting pump comprising two cavities, each of which is divided into an operating chamber and a working chamber by means of a movable partition wall in the form of a diaphragm, each of the working chambers being connected to a common working medium inlet chamber, located between the working chambers, through a respective flap valve mounted in a respective chamber wall, the working chambers being located inwardly with respect to the operating chambers and each operating chamber being located outwardly of an associated partition wall, said operating and working chambers each being provided with a valve-controlled inlet and outlet for gaseous operating medium and pump-transported liquid working medium, respectively, and including a movement transmission device, extending between the movable partition walls, for transmitting movement of one partition wall to the other, said movement transmission device having a spring element for compression and expansion in the movement transmission direction such that, responsive to relative pressure differences in the two operating chambers, one partition wall moves independently of the other partition wall.

2. A double-acting pump comprising two cavities, each of which is divided into an operating chamber and a working chamber by means of a movable partition wall in the form of a diaphragm, each of the working chambers being connected to a common working medium outlet chamber, located between the working chambers, through a respective flap valve mounted in a respective chamber wall, the working chambers being located inwardly with respect to the operating chambers and each operating chamber being located outwardly of an associated partition wall, said operating and working chambers each being provided with a valve-controlled inlet and outlet for gaseous operating medium and pump-transported liquid working medium, respectively, and including a movement transmission device, extending between the movable partition walls, for transmitting movement of one partition wall to the other, said movement transmission device having a spring element for compression and expansion in the movement transmission direction such that, responsive to relative pressure differences in the two operating chambers, one partition wall moves independently of the other partition wall.

3. A pneumatically driven double-acting pump comprising two cavities, each of which is divided into an operating chamber and a working chamber by means of a movable partition wall in the form of a diaphragm, each of the working chambers being connected to a common working medium inlet chamber and a common working medium outlet chamber, the inlet and outlet chambers located between the working chambers, through a respective flap valve mounted in a respective chamber wall, the working chambers being located inwardly with respect to the operating chambers and each operating chamber being located outwardly of an associated partition wall, and a movement transmission device, extending between the movable partition walls, for transmitting movement of one partition wall to the other, said movement transmission device having a coil spring for compression and expansion in the movement transmission direction such that a distance between the partition walls is variable responsive to relative gas pressure in the operating chambers.

4. The pump according to claim 3, wherein each of the operating chambers is provided with a valve-controlled inlet and outlet for gaseous operating medium.

5. The pump according to claim 3, wherein, through compression of said coil spring, increased pressure in a left operating chamber forces movement of a left diaphragm to empty a left working chamber before a pressure level in a right operating chamber has lessened sufficiently to allow movement of a right diaphragm.

* * * * *